US005782609A

United States Patent [19]

Ikemoto et al.

[11] Patent Number: 5,782,609

[45] Date of Patent: *Jul. 21, 1998

[54] VACUUM PUMP HAVING DIFFERENT DIAMETER ROTORS AND A DRIVE MOTOR SYNCHRONIZATION SYSTEM

[75] Inventors: Yoshihiro Ikemoto; Teruo Maruyama, both of Hirakata, Japan

[73] Assignee: Matsushita Electric Industrial Co., Ltd., Kadoma, Japan

[ * ] Notice: The term of this patent shall not extend beyond the expiration date of Pat. No. 5,449,276.

[21] Appl. No.: 494,737

[22] Filed: Jun. 26, 1995

[30] Foreign Application Priority Data

Jun. 27, 1994 [JP] Japan ..... 6-144836

[51] Int. Cl.[6] ..... F04B 49/06; F04B 17/00; F04B 35/04

[52] U.S. Cl. ..... 417/44.1; 417/199.2; 417/423.4; 417/423.5

[58] Field of Search ..... 417/2, 44.1, 199.1, 417/199.2, 201, 205, 423.4, 423.5, 424.1, 16–18; 418/2, 201.1

[56] References Cited

U.S. PATENT DOCUMENTS

| | | | |
|---|---|---|---|
| 3,724,427 | 4/1973 | Sauder | 123/8.07 |
| 4,808,077 | 2/1989 | Kan et al. | 417/2 |
| 4,850,806 | 7/1989 | Morgan et al. | 417/53 |
| 5,197,861 | 3/1993 | Maruyama et al. . | |
| 5,271,719 | 12/1993 | Abe et al. | 417/26 |
| 5,348,448 | 9/1994 | Ikemoto et al. | 417/17 |
| 5,354,179 | 10/1994 | Maruyama et al. . | |
| 5,393,201 | 2/1995 | Okutani et al. | 417/16 |
| 5,449,276 | 9/1995 | Maruyama et al. | 417/205 |

FOREIGN PATENT DOCUMENTS

| | | |
|---|---|---|
| 4-175491 | 6/1992 | Japan . |

*Primary Examiner*—Timothy Thorpe
*Assistant Examiner*—Xuan M. Thai
*Attorney, Agent, or Firm*—Wenderoth, Lind & Ponack

[57] ABSTRACT

A vacuum pump includes a plurality of rotors of different outer diameters accommodated in a housing so that a fluid transportation space is defined by the housing and the plural rotors. Rotary shafts are integrally formed with the respective rotors and a first motor, which is a high frequency motor, for driving the rotary shaft of the smaller diameter rotor as a driving shaft. A second motor, which is an AC servo motor or pulse motor, is provided for driving the other rotary shaft as a driven shaft. A rotation detecting device is provided adjacent each shaft for detecting rotating angles and/or rotating speeds of the first and second motors. Also provided is a fluid suction port and a fluid discharge port which are formed in the housing, and a control device for controlling rotation of the driven shaft based on data from the rotation detecting device so as to synchronize the rotation of the driven shaft driven by the second motor with that of the driving shaft driven by the first motor.

6 Claims, 5 Drawing Sheets

VACUUM PUMP HAVING DIFFERENT DIAMETER ROTORS AND A DRIVE MOTOR SYNCHRONIZATION SYSTEM

BACKGROUND OF THE INVENTION

The present invention relates to a vacuum pump used in production facilities of semiconductors, etc.

A vacuum pump is indispensable to forge a vacuum environment for a CVD apparatus, a dry etching apparatus, a sputtering apparatus, a vapor deposition apparatus, etc. in a production process of semiconductors, and is increasingly required to be sophisticated and elaborate as the production process tends to be proceeded in a cleaner and higher-vacuum condition.

In order to achieve a high vacuum, generally, a vacuum system which is a combination of a roughing pump (positive displacement pump) and a high vacuum pump (turbo molecular pump) is provided in the semiconductor equipment. A certain degree of vacuum is attained from the atmospheric pressure by the roughing pump which is then switched to the high vacuum pump, thereby to obtain a target high vacuum.

FIG. 6 indicates a screw-type vacuum pump as one example of a conventional positive displacement pump (roughing pump), in which reference numerals 101 denotes a housing; 102 a first rotary shaft; 103 a second rotary shaft; 104 and 105 cylindrical rotors supported by the respective rotary shafts 102 and 103; and 106 and 107 grooves threaded in the outer peripheries of the respective rotors 104 and 105. In the conventional screw type vacuum pump, the first rotary shaft 102 and the second rotary shaft 103 are arranged parallel to each other within the housing 101, and have rotors 104 and 105 mounted thereon. The rotors 104 and 105 are provided with threaded grooves 106 and 107, respectively. When the recessed part (groove) of one rotor 106 or 107 is meshed with the projecting part (land) of the other rotor 107 or 106, a closed space is defined therebetween. As both rotors 104 and 105 are rotated, the volume of the closed space is changed thereby to suck and discharge air.

FIG. 7 shows a kind of a conventional kinetic vacuum pump (high-vacuum pump), i.e., a vacuum pump of a screw groove type having a turbine blade. In the drawing, reference numerals represent respectively; 201 a housing; 202 a cylindrical rotor; 203 a turbine blade; 204 a screw groove; 205a and 205b magnetic radial bearings which support a rotary shaft 207; and 206 a magnetic thrust bearing. The conventional vacuum pump with a turbine blade as shown in FIG. 7 has the rotor 202 inside the housing 201, and the turbine blade 203 and the screw groove 204 formed in the lateral upper and lower parts of the rotor 202. Each of the turbine blade 203 and the screw groove 204 impresses momentum to gas molecules, to execute sucking and discharging.

The vacuum system referred to above has such drawbacks, though, as will be depicted below.

The conventional roughing pump (positive displacement pump) discharging at a region of viscous fluid close to the atmospheric pressure achieves only a low degree of vacuum up to approximately $10^{-1}$ Pa of an operating pressure. On the other hand, the conventional high vacuum pump (turbo molecular pump of a momentum transfer type ) attains approximately $10^{-8}$ Pa of an operating pressure, but is unable to discharge at a region of viscous fluid close to atmospheric pressure. As such, in a conventional arrangement, $10^{0}$ to $10^{-1}$ Pa is first obtained by the roughing pump (e.g., screw pump) and then, the high vacuum pump replacing the roughing pump achieves a required high vacuum.

In accordance with the recent multiplex production process of semiconductors, meanwhile, a multi-chamber system has been a mainstream in the semiconductor facilities, in where a plurality of vacuum chambers are independently driven to discharge air. However, since the multi-chamber system necessitates the foregoing vacuum system consisting of the roughing pump and high vacuum pump for every chamber, the system is bulky and complicated.

In order to eliminate the above convenience, one of the inventors has already proposed a wide-hand vacuum pump which is a complex pump. Specifically, a shaft of each of a plurality of rotors constituting a positive displacement pump is driven by an independent motor, with a momentum transfer-type pump coaxially formed above one rotor, whereby the rotors are synchronously rotated in a contactless fashion.

Also there has been proposed a vacuum pump wherein a positive displacement pump is constituted of a combination of rotors of different diameters and, a momentum transfer-type pump is formed coaxially above one rotor of the smallest diameter.

These proposals provide a clean and compact vacuum pump which is capable of realizing an ultra-high vacuum (not higher than $10^{-8}$ torr) singly.

SUMMARY OF THE INVENTION

The object of the present invention is to provide a vacuum pump for further miniaturizing the above proposed vacuum pump, thereby improving a reaching vacuum pressure through the enhancement of controlling safety in synchronization and the speed-up, etc.

In accomplishing these and other objects, according to one aspect of the present invention, there is provided a vacuum pump comprising:

- a plurality of rotors of different outer diameters accommodated in a housing so that a fluid transportation space is defined by the housing and the plural rotors;
- rotary shafts integrally formed with the respective rotors;
- a first motor, which is a high frequency motor, for driving the rotary shaft of the rotor of a smaller outer diameter as a driving shaft;
- a second motor, which is an AC servo motor or pulse motor, for driving the other rotary shaft as a driven shaft;
- rotation detecting means for detecting rotating angles and/or rotating speeds of the first and second motors;
- a fluid suction port and a fluid discharge port formed in the housing; and
- a control means for controlling rotation of the driven shaft based on data from the rotation detecting means so as to synchronize the rotation of the driven shaft driven by the second motor with that of the driving shaft driven by the first motor.

The vacuum pump according to the present invention includes a positive displacement pump constituted of a combination of a plurality of rotors of different outer diameters which are adapted to synchronously rotate without using a transmission means such as a timing gear, etc. based on a mechanical contact.

The rotor of a smaller diameter is driven by a high frequency motor. The other rotor of a larger diameter is driven by an AC servo motor on the basis of detecting signals from rotation detecting means such as encoders installed in the rotors of both small and large diameters, to be synchronously rotated with the rotors of small diameters in a contactless manner.

In other words, the vacuum pump of the present invention drives the rotors by controlling the synchronization in a master-slave relationship using the high frequency motor for driving the rotor of small outer diameter as a master side and AC servo motor for driving the rotor of large outer diameter as a slave side.

When the present invention is applied to a positive displacement screw pump, the rotating speed of each rotor is in inverse proportion to the diameter of the rotor. For instance, supposing that the rotor has a large diameter D and is driven at a speed of 20000 rpm, the rotor of a D/2 diameter should be rotated at a speed of 40000 rpm.

The high frequency motor is used to rotate the rotor of the small diameter in the present invention. The high frequency motor may be constituted of a copper rod having a rotary part generally in the form of a squirrel cage and a silicon steel plate layered over the copper rod, and therefore the high frequency motor is resistant to a rotational centrifugal force and fit to rotate at high speeds such as ten thousand rpm or more. However, the high frequency motor which is an asynchronous motor necessitates for its fine rotating angular control and speed control a complicate control such as a vector control or the like. In the meantime, the AC servo motor is used to rotate the rotor of the large diameter. A rotary part of the AC servo motor is generally in such structure that permanent magnets are attached to a rotary shaft. Outer peripheries of the permanent magnets should be coated and reinforced with a thin annular stainless steel or ceramics, or a tape of fibrous material such as glass fibers or carbon fiber so as to endure a rotational centrifugal force. However, even the reinforcing arrangement yields to the rotary centrifugal force when the motor rotates at high speeds or if the diameter of the magnet is increased. The AC servo motor is thus not suitable for high-speed rotation. Nevertheless, the AC servo motor demonstrates good exertion in highly accurate rotating angular control and speed control because of a strong torque for its size and a small moment of inertia and also because it is a synchronous motor.

According to the present invention, the control based on the master-slave relationship of a combination of two kinds of motors is effective to compensate for the drawbacks of motors while making full use of the respective merits.

In applying the present invention to a roughing pump, one of two rotors is reduced in outer diameter even though the vacuumizing efficiency is kept equal, so that the pump main body is made compact.

When a high vacuum pump comprised of threaded grooves or turbine vanes, etc. is provided on the same axis as that of the master rotor of a smaller diameter, the rotating speed is increased, so that the fundamental performance (reaching vacuum pressure, vacuumizing speed) of the high vacuum pump is remarkably improved.

BRIEF DESCRIPTION OF THE DRAWINGS

These and other objects and features of the present invention will become clear from the following description taken in conjunction with the preferred embodiment thereof with reference to the accompanying drawings, in which.

DETAILED DESCRIPTION OF THE PREFERRED EMBODIMENT

Figure 1:
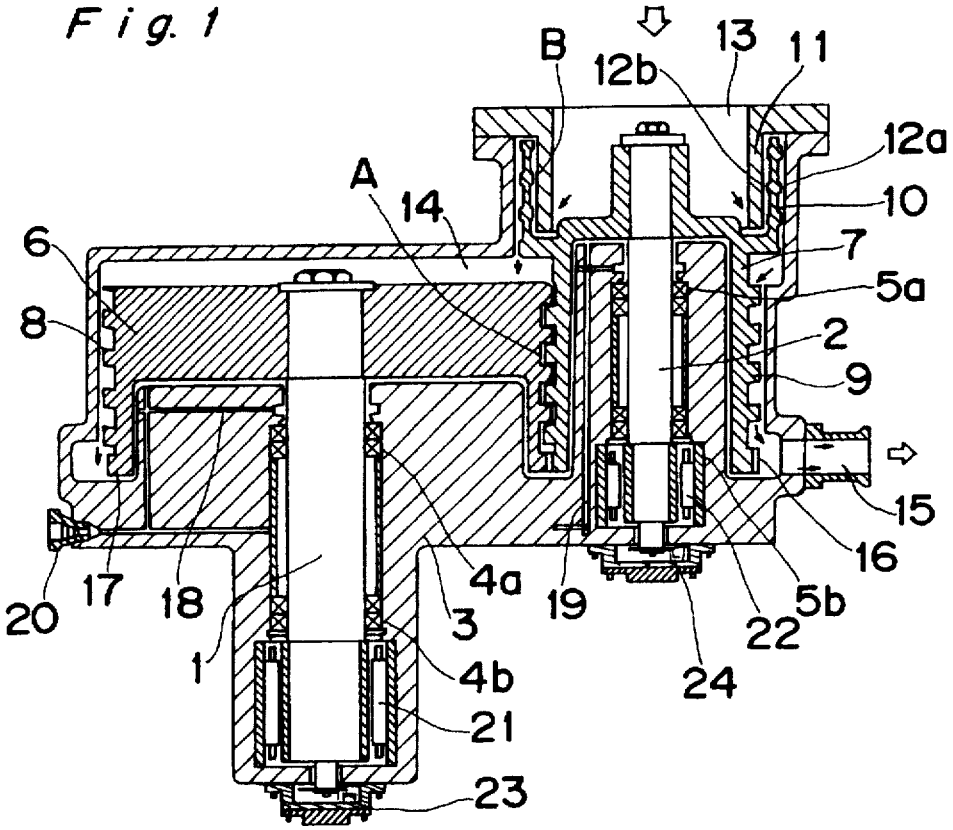
FIG. 1 is a sectional view showing a vacuum pump of a first embodiment of the present invention.

Before the description of the present invention proceeds, it is to be noted that like parts are designated by like reference numerals throughout the accompanying drawings.

Figure 2:
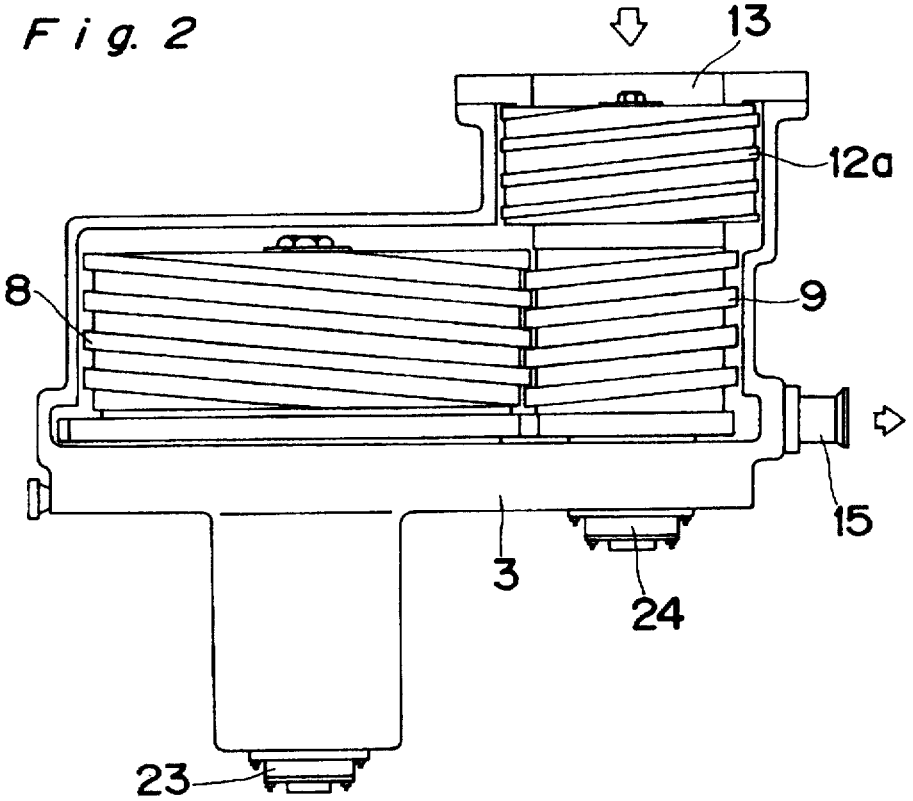
FIG. 2 is a side view with a part of a housing of the first embodiment removed.

FIGS. 1 and 2 indicate a vacuum pump for wide band in a first embodiment of a fluid rotating apparatus of the present invention. A first rotary shaft 1 and a second rotary shaft 2 are supported by bearings 4*a*, 4*b*, and 5*a*, 5*b* accommodated in a housing 3. A rotor 6 of a large-diameter cylinder and a rotor 7 of a small-diameter cylinder are fitted on the first and second rotary shafts 1 and 2, respectively. Threads 8, 9 are formed on outer peripheral surfaces of the rotors 6, 7 to mesh with each other. An area where the threads 8, 9 mesh with each other defines a section (A) constituting a positive displacement vacuum pump. In other words, a space confined by recessed and projecting parts of threads 8, 9 and housing 3 changes the volume periodically in accordance with the rotation of the rotary shafts 1 and 2, thereby acting to suck and discharge a fluid. When the outer diameter of the rotor 6 is D and the rotating speed is $\omega$, the outer diameter and rotating speed of the smaller rotor 7 are D/2 and $2\omega$.

The discharging efficiency of the pump in the embodiment is the same as that of a screw pump including a combination of two rotors of the equal diameter, because the smaller rotor 7 rotates twice when the larger rotor 6 rotates once. The entrapping volume or efficiency of one rotor is proportional to the outer diameter thereof.

A sleeve-like upper rotor 10 is provided integrally with the cylindrical rotor 7 above the second rotary shaft 2. The upper rotor 10 is accommodated in a gap formed by the housing 3 and a fixed sleeve 11 in a manner so as to be rotatable within the gap. Threads 12*a*, 12*b* are formed on the inner and outer peripheral surfaces of the upper rotor 10. The upper rotor 10, threads 12*a*, 12*b* and fixed sleeve 11 constitutes a section (B) forming a momentum transfer vacuum pump. The rotor 10 rotates twice a rotating speed of the larger rotor 6 of the section (A). A gas entering from a suction port 13 is sent to a space 14 housing the positive displacement-type threaded groove pump owing to a molecular dragging effect of the threads 12*a* and 12*b*. The gas flowing into the threaded groove pump is discharged out through a discharge port 15.

Figure 3:
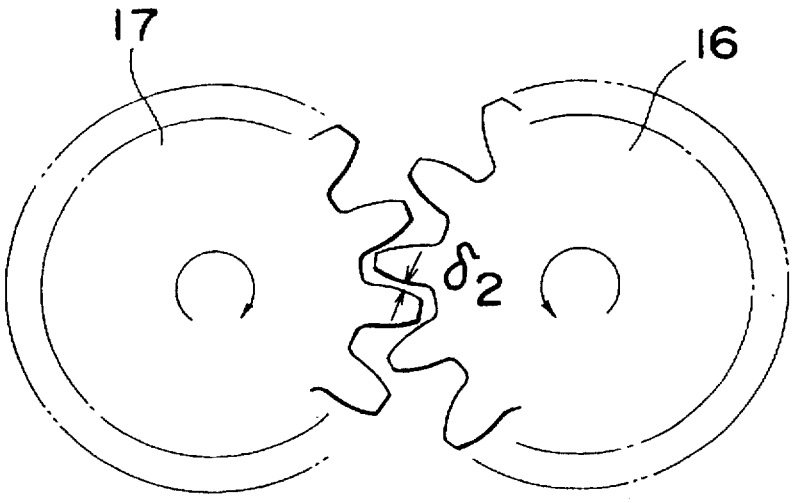
FIG. 3 is a plan view of contact prevention gears used in the first embodiment.

Contact prevention gears 16, 17 shown in FIG. 3 are respectively provided in the outer peripheral surfaces at the lower ends of the rotors 6, 7 to prevent the threads 8 and 9 from being in touch with each other. Each gear 16, 17 is coated with a solid lubricating film to stand metallic contact of some degrees. A backlash $\delta 2$ where the gears 16 and 17 engage with each other is designed to be smaller than a backlash $\delta 1$ (not shown) at a portion where the screw threads 8 and 9 formed in the outer peripheral surfaces of the rotors 6 and 7 mesh with each other. Therefore, when the rotary shafts 1 and 2 smoothly rotate synchronously, the contact prevention gears 16 and 17 are never in touch with each other. If the synchronous rotation is broken for some reason or other, the gears 16 and 17 come to touch each other prior to the contact of the grooves 8 and 9, thereby to prevent the collision of threads 8 and 9. Although a practical level of processing accuracy is unattainable for members of the vacuum pump if the backlashes δ1 and δ2 are so minute, in such case, the backlash δ1 between the threads 8 and 9 may be slightly increased thereby to sufficiently maintain the performance of the vacuum pump (reaching degree of vacuum, etc.) so long as the rotary shafts 1 and 2 rotate at high speeds, because the total leaking amount of fluid in one operation cycle of the pump is proportional to the time required for one cycle. Accordingly, the vacuum pump of the present embodiment in which the rotary shafts are rotatable at high speeds ensures backlashes δ1 and δ2 of a required size with normal processing accuracy to prevent the collision of the threads 8 and 9.

In the embodiment, ball bearings are used and lubricated with grease. Moreover, the invasion of grease to the fluid operating chamber is prevented by a gas purge mechanism with the use of clean high-pressure nitrogen gas prepared in general semiconductor factories, etc. In FIG. 1, reference numerals 18 and 19 are feed paths for nitrogen gas, and 20 is a feed joint set in the housing 3.

The rotors 6 and 7 are rotated, while keeping constant a rotating speed ratio determined by the ratio of outer diameters, at a speed of several tens of thousands rotations by an AC servo motor 21 and a high frequency motor 22 independently mounted at the lower parts of the rotary shafts 1 and 2, respectively.

Figure 5:
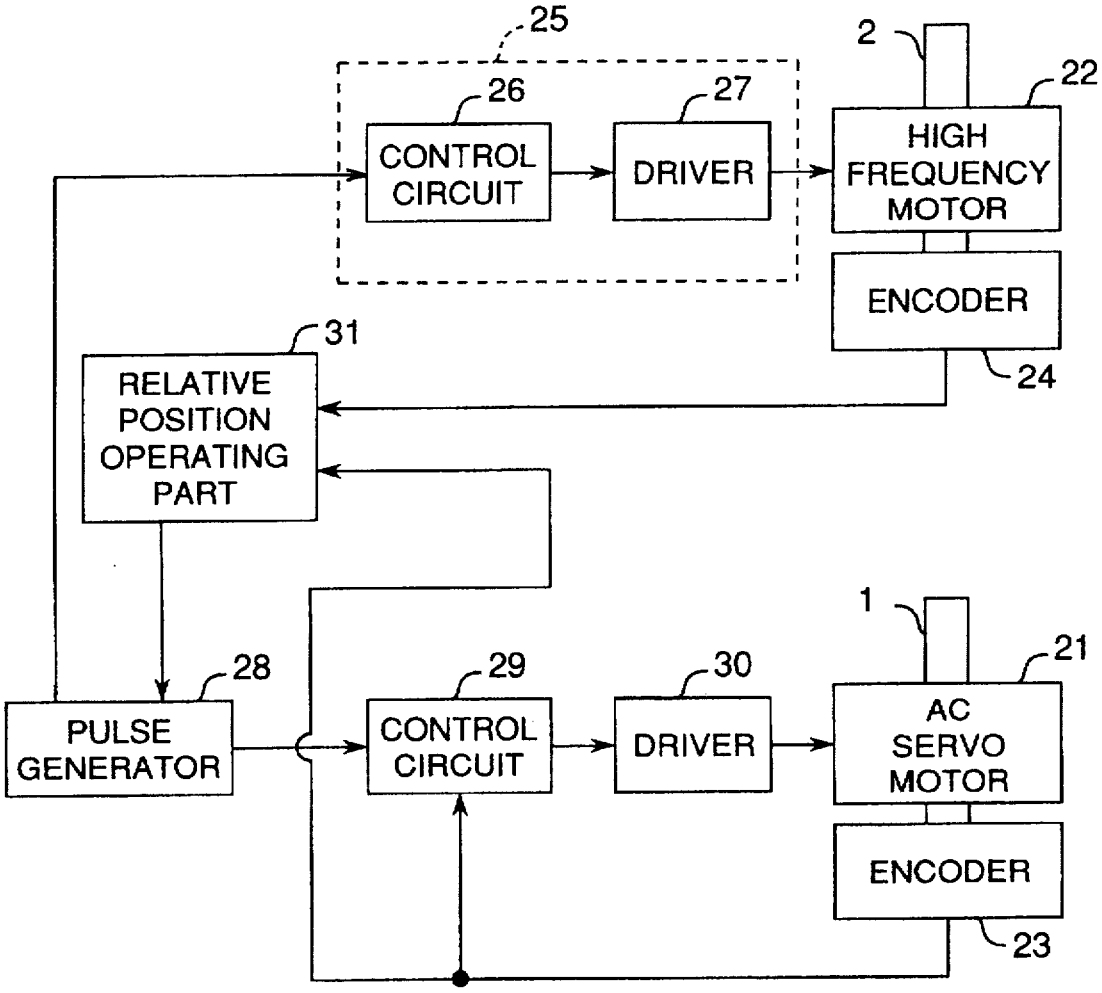
FIG. 5 is a block diagram illustrating the synchronization control system of the present invention.
Figure 6:
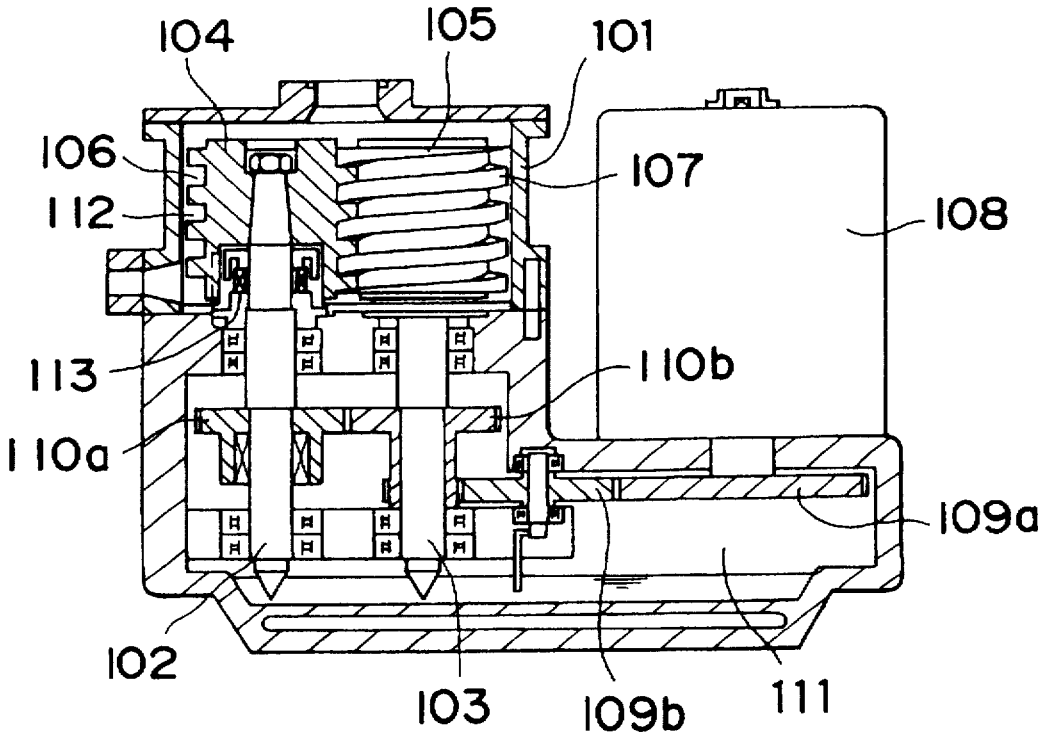
Fig. 6 ( PRIOR ART )
FIG. 6 is a sectional view of a conventional screw pump.
Figure 7:
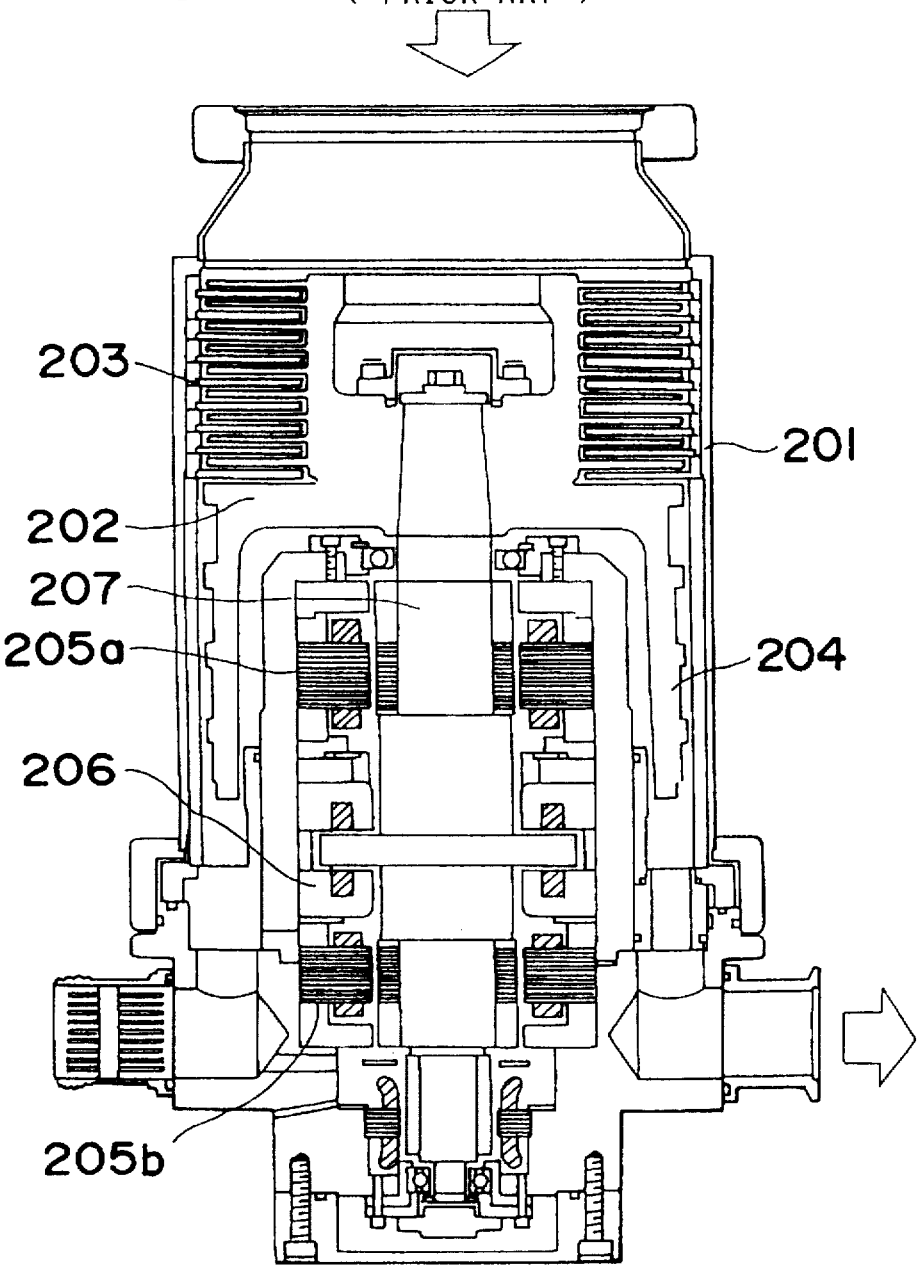
Fig. 7 ( PRIOR ART )
FIG. 7 is a sectional view of a conventional turbo molecular pump.

A controlling method for synchronous rotation of the rotors 6 and 7 in the embodiment will be described with reference to a block diagram of FIG. 5.

The high frequency motor 22 is a driving motor of the master side, rotating at a stable speed by pulses of a stable frequency for speed instruction generated from a control circuit 26 and a driver 27 of a driving/controlling part 25 (inverter). The data of the frequency of pulses generated by the control circuit 26 is fed to a pulse generator 28 to form a rotation instruction for the AC servo motor 21 at the slave side. The pulse generator 28 calculates a frequency of pulses so as to rotate the high frequency motor 22 and AC servo motor 21 at an equal speed, and sends the calculated frequency to a control circuit 29 for the AC servo motor 21. The control circuit 29 outputs a signal to a driver 30 to drive the AC servo motor 21, whereby the AC servo motor 21 is rotated at the equal speed to that of the high frequency motor 22. Encoders 23 and 24 installed in the motors 21 and 22, read and take angular positional signals when the motors stop and send the signals to a relative position operating part 31. A shift from a set position of each motor is calculated and sent to the pulse generator 28. In the case where the high frequency motor 22 advances further than the AC servo motor 21, the number of instruction pulses generated from the pulse generator 28 is increased based on the data of the relative position operating part 31, thereby to move the position of the AC servo motor 21 forward. Accordingly, the high frequency motor 22 and AC servo motor 21 are synchronized in rotating speed and position. If the high frequency motor 22 is positionally behind the AC servo motor 21, the number of instruction pulses formed by the pulse generator 28 is reduced on the basis of the data from the relative position operating part 31, so that the AC servo motor 21 is delayed and synchronized with the high frequency motor 22 in rotating speed and position.

Figure 4:
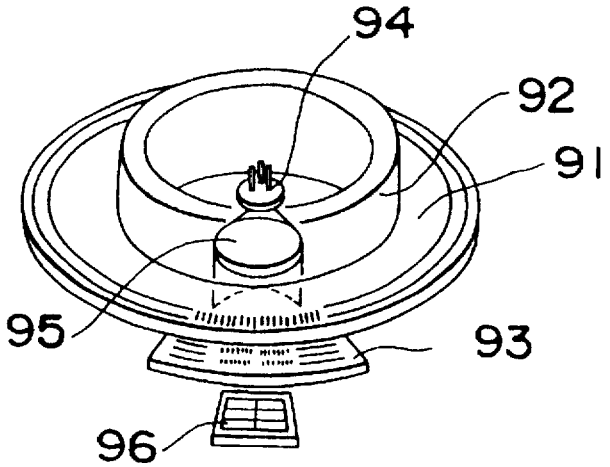
FIG. 4 is a perspective view of a laser-type encoder used in the first embodiment.

Each rotary encoder 23, 24 may be a magnetic encoder such as a resolver or the like, or a general optical encoder. The instant embodiment employs a laser encoder with high resolution and high responding speed applying refraction and interference of laser lights. In FIG. 4 showing an example of the laser encoder, a moving slit plate 91 having many slits arranged in a circle is rotated by a shaft 92 coupled to the first, second rotary shaft 1, 2. A fixed slit plate 93 facing the moving slit plate 91 has slits disposed in the shape of a fan. A light from a laser diode 94 passes through a collimator lens 95 and further through slits of slit plates 91 and 93 to reach a photodetecting element 96.

The fluid rotating apparatus according to the present invention is embodied, e.g., as an air-conditioner compressor or the like. The rotors of the rotary part (corresponding to rotors 6 and 7 in FIG. 1) may be a tool type, a gear type, a single-lobe type, a double-lobe type, a screw type, an outer circumferential piston type (none is shown in the drawings), etc.

The vacuum pump of the present invention controls the synchronous rotation electronically, similar to, for example, the vacuum pump already proposed in U.S. Pat. No. 5,197,861 and U.S. Pat. No. 5,354,179 which correspond to the published specification of Japanese Patent Laid-Open Publication No. 4-175491 (175491/1992), and is accordingly advantageously clean, compact and space-saving.

Since the momentum transfer-type vacuum pump is provided coaxially above at least one of the rotors, the embodiment realizes a complex vacuum pump for wide band capable of vacuumizing to a high vacuum (not higher than $10^{-8}$ torr) from the atmospheric pressure all at once.

In addition to the foregoing features of the already-proposed vacuum pump, the present invention displays further effects as follows.

(1) When constituted as a pump for wide band, the pump attains a higher vacuumizing speed and a lower reaching vacuum pressure at a high vacuum region while maintaining sufficient vacuumizing efficiency at a low vacuum region.

(2) A sufficiently stable control system is realized to outer disturbances disturbing the synchronization control or the synchronization control at a transient time when the pump starts to operate.

The reason for the above (1) will be discussed with reference to the embodiment of the present invention (FIG. 1).

According to the embodiment, a plurality of rotors of different outer diameters are combined to constitute, for instance, the positive displacement-type screw pump and moreover, a high vacuum pump, e.g., threaded groove pump is formed coaxially above the smaller diameter rotor.

In the meantime, the larger diameter rotor is driven by the AC servo motor in response to detecting signals from the encoders of both rotors so as to maintain a noncontact synchronous rotation with the smaller diameter rotor.

The small diameter rotor uses the high frequency motor which is inferior in highly accurate control of a rotating angle and an angular velocity, but favorably rotates at high speeds. On the other hand, the rotor of the larger diameter uses the AC servo motor (or a pulse motor) which, contrary to the high frequency motor, is able to minutely control a rotating angle and provide excellent control of an angular velocity. That is, the vacuum pump of the present invention drives each rotor through synchronization control according to the master-slave system using the high frequency motor (smaller rotor) as a master and the AC servo motor (larger rotor) as a slave.

In other words, advantages of both motors are fully utilized and disadvantages of the motors are compensated mutually in a combination of motors of different characteristics.

Since the smaller rotor is rotatable at high speeds, when the present invention is practiced as a pump for wide band, the performance (discharging pressure, reaching (ultimate) vacuum pressure) of the high vacuum pump coaxially set above the smaller rotor is improved. Alternatively, the outer diameter of the high vacuum pump may be reduced with the performance maintained.

Needless to say, the present invention is utilizable as a clean and compact roughing pump even when the momentum transfer-type pump section section (B) in FIG. 1) is removed. In this case, the above-identified effect (2) is naturally exerted. Since one of the two rotors is of a reduced diameter, the whole pump becomes light-weight and compact.

Although the present invention has been fully described in connection with the preferred embodiment thereof with reference to the accompanying drawings, it is to be noted that various changes and modifications will be apparent to those skilled in the art. Such changes and modifications are to be understood as included within the scope of the present invention as defined by the appended claims unless they depart therefrom.

What is claimed is:

1. A vacuum pump comprising:

a housing having a fluid suction port and a fluid discharge port;

a first rotary shaft rotatably mounted in said housing;

a second rotary shaft rotatably mounted in said housing;

a first rotor mounted on said first rotary shaft within said housing;

a second rotor mounted on said second rotary shaft within said housing, said second rotor having a diameter which is smaller than that of said first rotor;

a first motor, comprising an AC servo motor or a pulse motor, for driving said first rotary shaft which is connected to said first rotor;

a second motor comprising a high frequency motor for driving said second rotary shaft which is connected to said second rotor;

a rotation detector for detecting rotating angles and/or rotating speeds of said first motor and said second motor; and a control means for controlling said first motor based on data from said rotation detector so as to synchronize rotation of said first rotary shaft driven by said first motor with that of said second rotary shaft driven by said second motor by controlling only said first motor.

2. The vacuum pump as claimed in claim 1, further comprising a high-vacuum pump structure which is mounted coaxially on said second rotor.

3. The vacuum pump as claimed in claim 1, wherein said rotors have screws or intermeshing threads in their outer peripheral surfaces.

4. The vacuum pump as claimed in claim 1, wherein said second rotor is rotated at a speed of at least ten thousand rpm by said second motor.

5. The vacuum pump as claimed in claim 1, wherein said second rotor is rotated by said second motor at a speed which is substantially greater than a speed of said first rotor which is rotated by said first motor.

6. The vacuum pump as claimed in claim 1, wherein said control means includes:

a relative position operating part for receiving angular position signals detected by said rotation detector when said first and second motors stop, and calculating any shift from predetermined relative positions of said first and second motors and outputting calculated data;

a pulse generator for calculating a frequency of pulses based on calculated data from said relative position operating part so as to synchronize rotation of said first and second motors at an equal speed and position, and outputting the calculated frequency; and a first motor control means for receiving output data from said pulse generator and controlling said first motor in order to synchronize rotation of said first rotary shaft driven by said first motor with that of said second rotary shaft driven by said second motor.

* * * * *